United States Patent [19]

Tschudy et al.

[11] 4,434,865

[45] Mar. 6, 1984

[54] POWER TRANSMISSION FOR A CLEANER

[75] Inventors: Donald B. Tschudy, Canton; Charles R. Morrow, Alliance, both of Ohio

[73] Assignee: The Hoover Company, North Canton, Ohio

[21] Appl. No.: 298,190

[22] Filed: Aug. 31, 1981

[51] Int. Cl.[3] ..... B62D 51/04

[52] U.S. Cl. ..... 180/19 H; 15/340; 192/113 A

[58] Field of Search ..... 180/19 H; 192/70.12, 192/113 A; 15/340

[56] References Cited

U.S. PATENT DOCUMENTS

| | | | |
|---|---|---|---|
| 1,742,804 | 1/1930 | Carhart | 192/70.12 |
| 1,759,755 | 5/1930 | Lindner | 192/70.12 |
| 2,138,239 | 11/1939 | Irgens | 180/19 H |
| 3,218,876 | 11/1965 | Berger | 74/202 |
| 3,237,738 | 3/1966 | Suppes et al. | 192/70 |
| 3,581,591 | 6/1971 | Ziegler et al. | 74/377 |
| 3,618,687 | 11/1971 | Ripple et al. | 180/19 H |
| 4,249,281 | 2/1981 | Meyer et al. | 15/340 |

*Primary Examiner*—John A. Pekar
*Assistant Examiner*—D. Lynn Fugate
*Attorney, Agent, or Firm*—Gerald H. Kreske; Richardson B. Farley

[57] ABSTRACT

The structure comprehends a power transmission for a power drive cleaner where the clutching arrangement is on the output shaft that provides a direct geared drive to the wheels.

11 Claims, 17 Drawing Figures

POWER TRANSMISSION FOR A CLEANER

BACKGROUND OF THE INVENTION

1. Field of the Invention

The invention relates to power driven cleaners, and more specifically, to a power drive cleaner having a geared transmission and clutching arrangement for driving the wheels of the power driven cleaner.

2. Description of the Prior Art

The use of power driven cleaners is old and well known including clutched gear trains to alternately drive the power drive cleaner in fore and aft directions. These arrangements, however, heretofore have not utilized a direct gear drive to the wheels to provide another convenient, stepped reduction for the cleaner motor nor have they utilized a clutched output shaft in a power train utilizing a lay shaft arrangement. Additionally, no provision has been made for the positive cooling of the clutching structure to enhance its service life.

Accordingly, it is an object of the invention to provide a transmission with direct gear drive to the wheels of the cleaner.

It is another object of the invention to provide a cleaner transmission having a lay shaft with clutching on the output shaft of the transmission.

It is still further object of the invention to provide an input, output and lay shaft gearing arrangement with clutching on the output shaft and direct gear drive to the cleaner wheels.

It is an additional object of the invention to provide cooling for the clutching arrangement of a power drive cleaner.

It is yet another object of the invention to provide an improved, compact power train structure for a power drive cleaner.

SUMMARY OF THE INVENTION

The invention provides a transmission for a power drive cleaner including a movable handle which motivates a Bowden cable or the like reciprocatorally to pivot a lever mounted adjacent the transmission that provides for clutching force for the power drive cleaner.

The transmission includes an input shafting, a lay shaft and an output shaft on which the clutching arrangement is maintained. The input shafting is belt driven by an external pulley mounted with the shafting. Also mounted with this shafting are a pair of spaced helical, relatively small gears that provide the drive to the output shaft. The rightwardmost of these gears directly meshes with a larger diameter helical gear for speed reduction, this last gear mounted on the output shaft and rotatable thereon and when clutched furnishing reverse drive.

The leftwardmost of these small input gears meshes with a helical gear on a lay shaft, with this helical gear, in turn, meshing with a second large helical gear on the left end on the output shaft. This arrangement provides forward drive of a slightly higher speed than the reverse drive.

In order to engage the large gears on the output shaft, alternately, a series of clutch disks are mounted in hub ends of these gears. Movement of a clutch actuator, as motivated by the clutch lever, towards either gear provides a clutching force for it and provides a drive between that gear and the output shaft. Of course, dependent upon whichever large gear is clutched, the output shaft provides forward or rearward drive.

The ends of the output shaft carry pinions fast with it to rotate therewith. These pinions engage in internal gearing in the drive wheels of the power drive cleaner to provide the actual drive to propel the power drive cleaner.

In order to ventilate the clutching disks for the transmission, slots are provided in its housing ends and cooling vanes are molded integrally, radially extending within the large clutch gears. At one side, adjacent the clutch disks, the molded cooling vanes tends to pull air through the ventilating slot at the transmission end. It constantly rotates with its large clutch gear on the output shaft and pulls air through the large gear and around the outside radially periphery of the clutch disks. Also, impeller blading is attached to the output shaft and rotates with it whenever the output shaft is clutched to engage it with a respective large output gear. This draws additional cooling air over both clutch plate sets, including the one under load.

DESCRIPTION OF THE DRAWINGS

Reference now may be had to the accompanying Drawings for a better understanding of the invention, both as to its organization and function, with the illustration being only exemplary, and in which.

DETAILED DESCRIPTION OF THE PREFERRED EMBODIMENT

Figure 1:
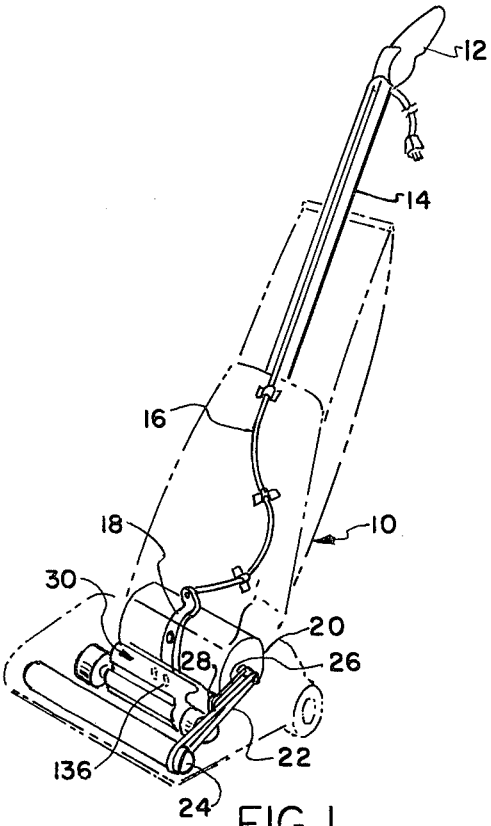
FIG. 1 is a perspective view of a cleaner incorporating the transmission of the invention.
Figure 2:
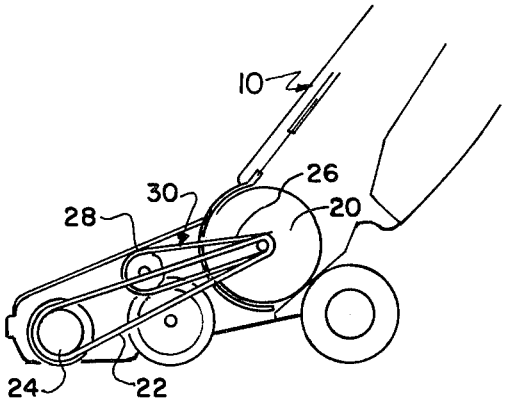
FIG. 2 is a fragmentary, somewhat diagramatic elevational view of the cleaner of FIG. 1.
Figure 6:
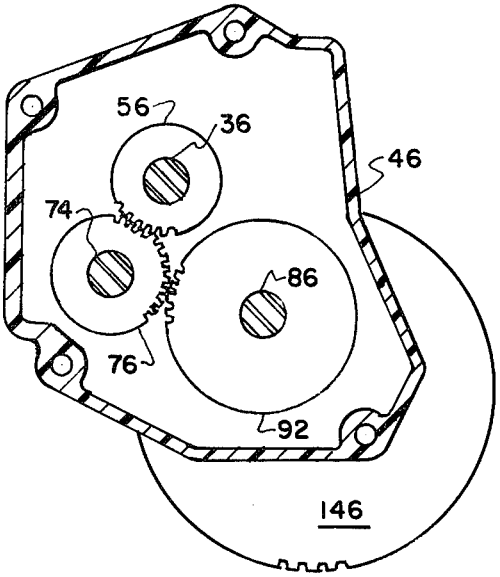
FIG. 6 is an elevational view of the transmission taken on line 6—6 of FIG. 5.
Figure 7:
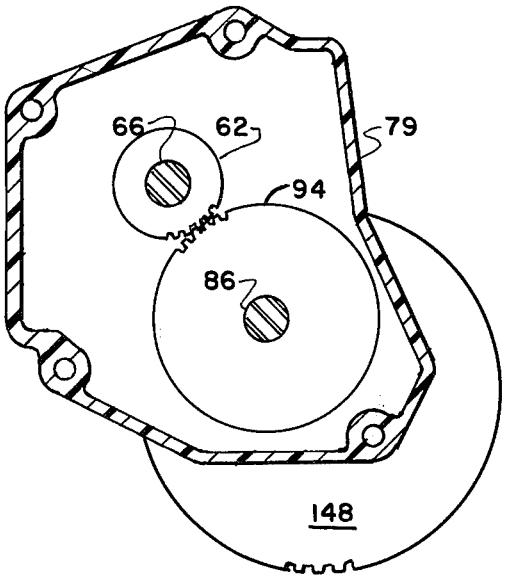
FIG. 7 is an elevational view of the transmission taken on line 7—7 of FIG. 5.
Figure 14:
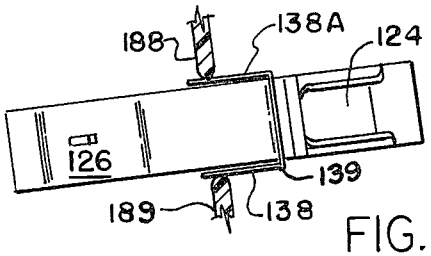
FIG. 14 is a view of the clutch actuator taken on line 14—14 of FIG. 12.

There is shown in FIGS. 1 and 2, a cleaner 10 having a reciprocally sliding hand grip 12, mounted on a handle 14, as is conventional in the art. A flexible rod or Bowden wire 16 extends downwardly from the hand grip to move with it, with its bottom end connected to a pivoted lever 18 mounted with a motor-fan system 20.

The motor-fan system 20 drives; through a belt 22, an agitator 24 to provide the agitator function for the cleaner 10. The motor-fan system 20 also drives a belt 26 which, in turn, provides power to a belt pulley 28 for a transmission 30, the inventive aspect of this Application.

Turning now to the remaining Figures, it can be seen that the transmission 30 includes a first input shaft 32 driven by pulley 28, made fast on it by means of a nut 34 and a threaded portion 36 on the first shaft 32, the nut 34 being received in a hexagonal blind bore (not shown) in the outer side of the pulley 28. A thrust spring washer 38 and a ball bearing 40, as well as a small hub 42 on pulley 28, provide the bearing surface for the pulley end of shaft 32 by being received in a counter bore 43 in a boss 44 integral with a housing half 46. The bearing 40 abuts thrust washer 38 which in turn abuts shoulder 45 on shaft 32.

The shaft 32 extends rightwardly through a counter bore 48 centered on the counter bore just mentioned in boss 44 to receive a ball bearing 50 and a washer 52, the bearing abutting a shoulder 34 on shaft 32. These elements are received in the counter bore 48 in boss 44 and serve as the inboard bearing means for the shaft 32. Mounted inwardly of the washer 52 on a shaft 32 is a helical gear 56 which is held tight against the washer 52 by means of a nut 58 of castellated cross sectional or tri-lobular form which is received in a similarly shaped counter bore 60 in gear 56 and drawn down by threads 61 on the end of the shaft until the nut 58 pulls the gear 56 tightly against the washer 52. The gear 56 is then fast with the shaft through the interengagement of the castellated or tri-lobular counter bore 60 with the castellated or tri-lobular nut 58. The bearings 40 and 50 are provided as ball bearings to absorb the thrusts imposed by the driving belt 26.

A second helical gear 62 having an inner, castellated end telescopes within the castellated or tri-lobular counter bore 60 of helical gear 56 so as to be interengaged with this gear and driven by it directly and thereby indirectly by the pulley 28. this second helical gear is piloted at its other end by a sleeve bearing 64 that is mounted in a bore 65 therein, a stub shaft 66 for the said helical gear being received in a bore 68 of a boss 70 in a press fit relationship.

This completes the description for the input shaft means 72 and gearing for the transmission 30.

A layshaft 74 formed of two stub shafts 73 and 75 is provided with helical gear 76 for a reversal on rotation for the transmission 30. The helical gear 76 then serves as an idler or back gear. The lay stub shafts 73, 75 are press fit into bosses 77, 78 on the housing half 46 and a rightward housing half 79 so that the lay shaft 74 is dead. These housing halves may be attached together by any conventional way. The helical lay shaft gear 76 is piloted on the shaft and bearingly mounted by sleeve bearing 80 at its end engaging the helical gear 56. The gear 76 is like the second helical gear 62 but is reversed on lay shaft 74 with its castellated or tri-lobular end riding on lay shaft 74 as the gear 76 rotates as driven by the helical gear 56. Because of its extended length the lay shaft year 76, when mounted, abuts a washer 82, disposed at its geared end, which in turn abuts the inward face of the boss 77 and the gear also abuts, at its other end the inner face of boss 78 through a washer 84.

An output shaft 86 extends through housing halves 46 and 79 to be rotatably mounted in bosses 88, 90, respectively by sleeve bearings 89, 91 press fit in bores 93, 95. This shaft carries a pair of hubbed helical gears 92, 94 which mesh with lay gear 76 and input gear 62, respectively, so that the gears 92 and 94 are driven in opposite direction, being free to rotate on output shaft 86 through bores 96, 96 (only one shown) on sleeve bearings 97, 97 (only one shown). A hub 98 on hub gear 92 is internally ribbed or castellated and slotted to receive a series of clutch disks 102, 104, 104A, with disks 102, 104 separated by a pressure disk 106. Another pressure disk 108 is disposed outboard of the disk 104A. The disks 102, 104, 104A, for example, include radially extending arms or tabs 102A, 104B and 104C (only one indicated) for each disk which protrude into outwardly opening slots such as slot 104D in hub 98 to provide a driving relationship between the gear 92 and the clutch disks 102, 104 and 104A, with these disks, in both clutched and unclutched condition, rotating with the gear 92. At the same time, the pressure disks 106 and 108 are fast with the output shaft. Hub 100 of hub gear 94, similarly has clutch disks 103, 105, 105A, 107 and 109. The driving disks, e.g., 102, 104 and 104A are composed of a conventional rubber matrixed composition while the driven disks, e.g. 106 and 108 are steel.

Disposed inboard of the hubbed helical gears 92, 94 are a pair of impeller fans 110 and 112 which are internally splined, by extensions of their blading, to an output shaft spline 114 to rotate with it when driven. The impeller fans provide cooling air to the clutch disks as will become apparent as the description proceeds. The spline piece 114 is press fit on output shaft 86, with knurling between the shaft 86 and the bore of the spline piece 114 making them fast to each other. Thus, the impeller fans 110 and 112 rotate with the output shaft 86 as it rotates.

The splined piece 114 also furnishes the drive between the hubbed helical gears 92 and 94 and the shaft 86 since the pressure plates 106,108 of the clutch are also internally splined to rotatably drive spline piece 114.

Clutching pressure is applied to the transmission 30 by means of a bearing cartridge 116 which can shift axially along spline piece 114 to apply clutching at the helical hub gear 92 or the helical hub gear 94. The bearing cartridge 116 ideally includes, for its bearing support, a thrust bearing 118 which absorbs the thrust generated by the clutching action through the Bowden wire 16. A pair of tabs 120,120A extend radially from bearing cartridge 116 to be engaged by a clutch actuator 122 having clutch actuator halves 124 and 126. Each of the clutch actuator halves has a short slot 128, 129 for engagement by a respective tab 120,120A, with the clutch actuator halves 124,126 being connected together by a rivet 127 through small holes 131,131 in each of the clutch actuator halves 124 and 126.

Clutch actuator half 124 has a pair of radially outwardly extending tabs 136,136A and a pair of radially inwardly extending spring tabs 138,138A. Tabs 136,136A are formed on a U-shaped piece 137 and capture the bottom end of pivoted lever 18 between them so that its pivoting moves clutch actuator 122, tabs 120, and bearing cartridge 116 axially rightwardly or leftwardly, clutching or declutching either helical hubbed gear 92 or 94 to output shaft 86. The radially inwardly extending spring tabs 138,138A are formed by a U-shaped piece 139 and their function will be described in greater detail later. The U-shaped pieces 137 and 139 are mounted to clutch actuator half 124 by the same rivet 127.

Mounted outwardly of housing halves 46 and 79, by being press fit on the ends of output shaft 86, are a pair of wheel driving pinions 140 and 142. These pinions mesh in internal gears 144,145 in wheels 146 and 148. These wheels are mounted on stub shafts 150 and 152, press fit in their respective housing halves at bores 154,154 (only one shown). The wheels 146 and 148 are mounted with washers 156,158 on either side of them on stubshafts 150 and 152 with the wheels 146 and 148 abutting the outer edges of circular flanges 160 and 162 on the housing halves. Seals 167 and 169 are provided for the wheels. Axially outwardly of the cylindrical flanges 160 and 162, are large circular bosses 164 and 166 which engage the inner periphery of the wheels 146 and 148 to help pilot them and provide sure movement of the cleaner 10 over the floor or rug which it is traversing. A pair of C-clips 168 and 170 mounted in grooves on the end of the output shaft 86 maintain the wheels 146 and 148 with the transmission 30.

Figures 5, 8, 15, 16:
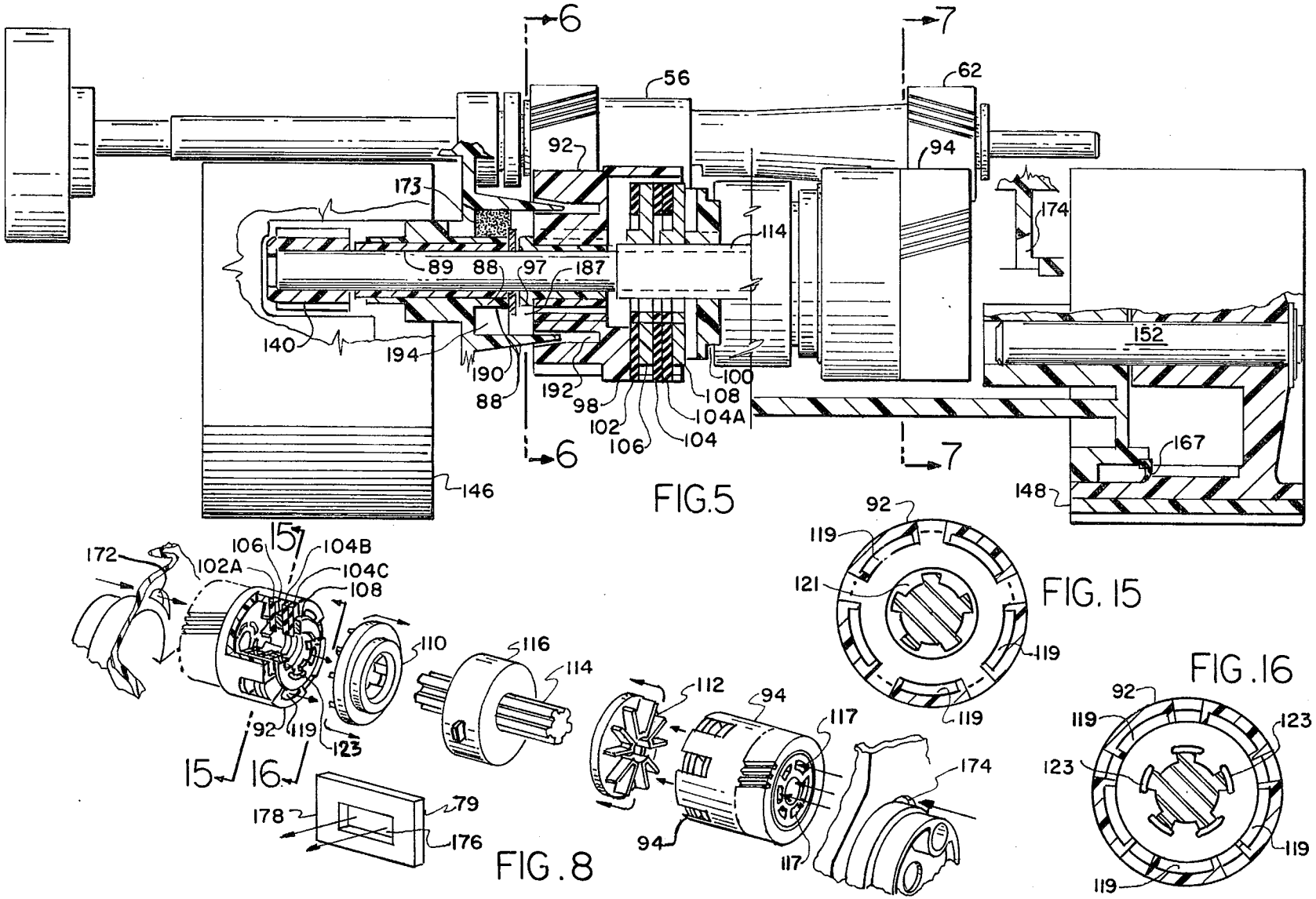
FIG. 5 is an elevational, partly cross sectional view of the transmission with certain parts omitted.
FIG. 8 is an exploded perspective view of the clutch and gearing related housing structure showing the cooling air flow.
FIG. 15 is a cross sectional view of a mounted clutch disk taken on line 15—15 of FIG. 8.
FIG. 16 is a cross sectional view of a mounted clutch disk taken on line 16—16 of FIG. 8.
Figure 9:
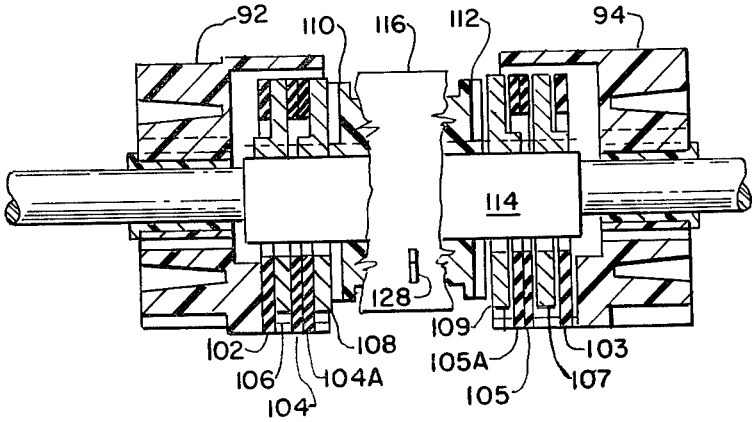
FIG. 9 is an elevational cross sectional view of parts of the transmission showing the leftwardmost clutch engaged to provide forward drive.
Figure 10:
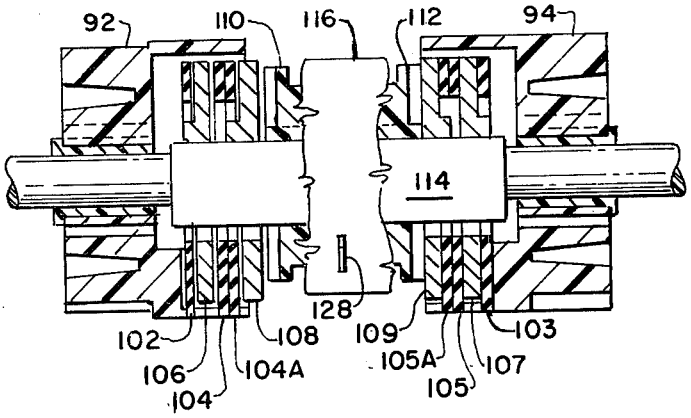
FIG. 10 is an elevational cross sectional view of parts of the transmission showing the rightwardmost clutch engaged to provide rearward drive.
Figure 11:
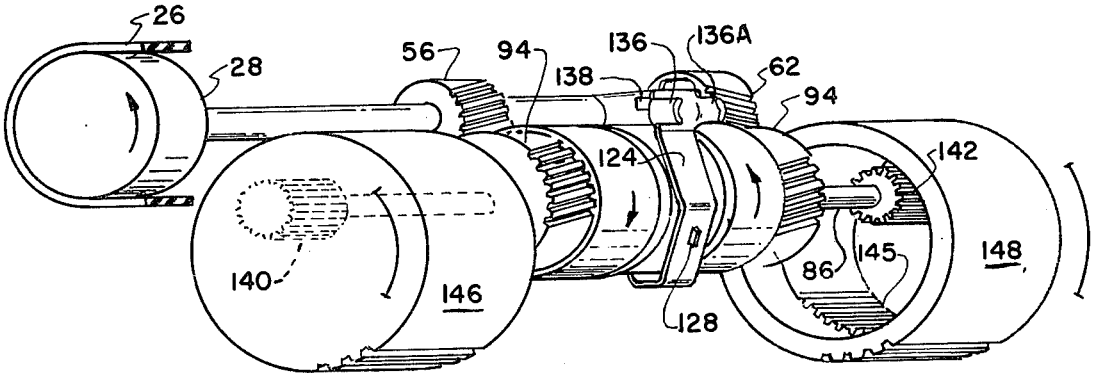
FIG. 11 is a perspective view of the transmission with it in neutral.

Cooling air for the clutches of the transmission 30 enters the housing halves 46 and 79 by a pair of slots 172 and 174 through filters 173 and 175 and, as indicated by the arrows (FIG. 8), passes through the hubbed gears 92 and 94 and their hubs 98 and 100, respectively. These hubs contain the clutch disks 102, 104, 104A, 106 and 108 and the clutch disks 103, 105, 105A, 107 and 109, thereby cooling the clutch and pressure surfaces and insuring longer life for them. Intermittent motive force to the cooling air is given by the impeller fans 110, 112 when clutching occurs and into which the air passes and is discharged through a centrally located slot 176 formed half in each housing half 46 and 79, respectively. The outwardly extending tabs 136 on the clutch actuator half 124 extend through this slot. A filter pad 178 of generally, rectangular prismatic shape may be placed behind this slot to act as a rough filter for the transmission 30.

Figure 4:
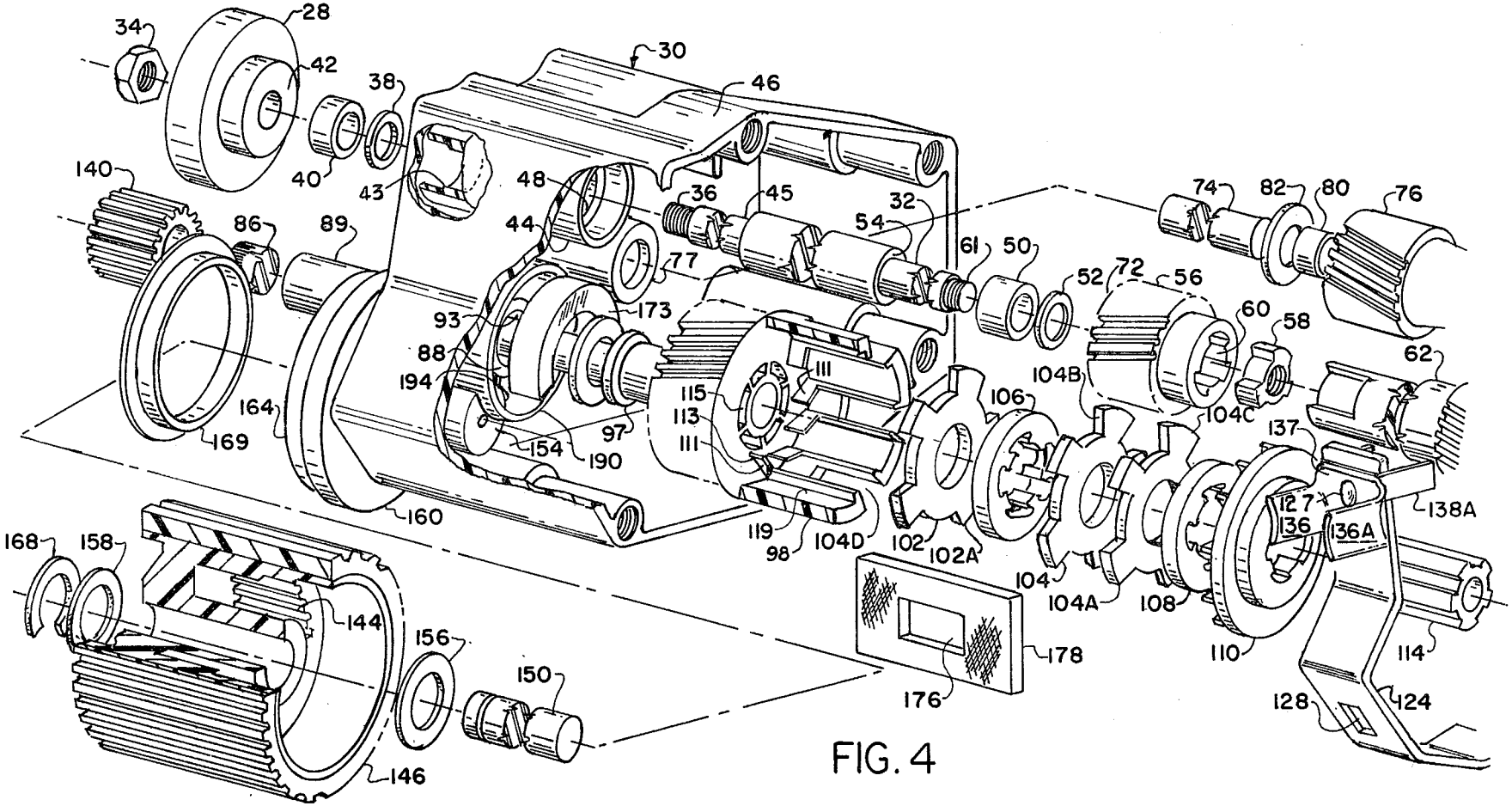
FIG. 4 and 4A are exploded isometric views of the transmission.
Figure 4A:
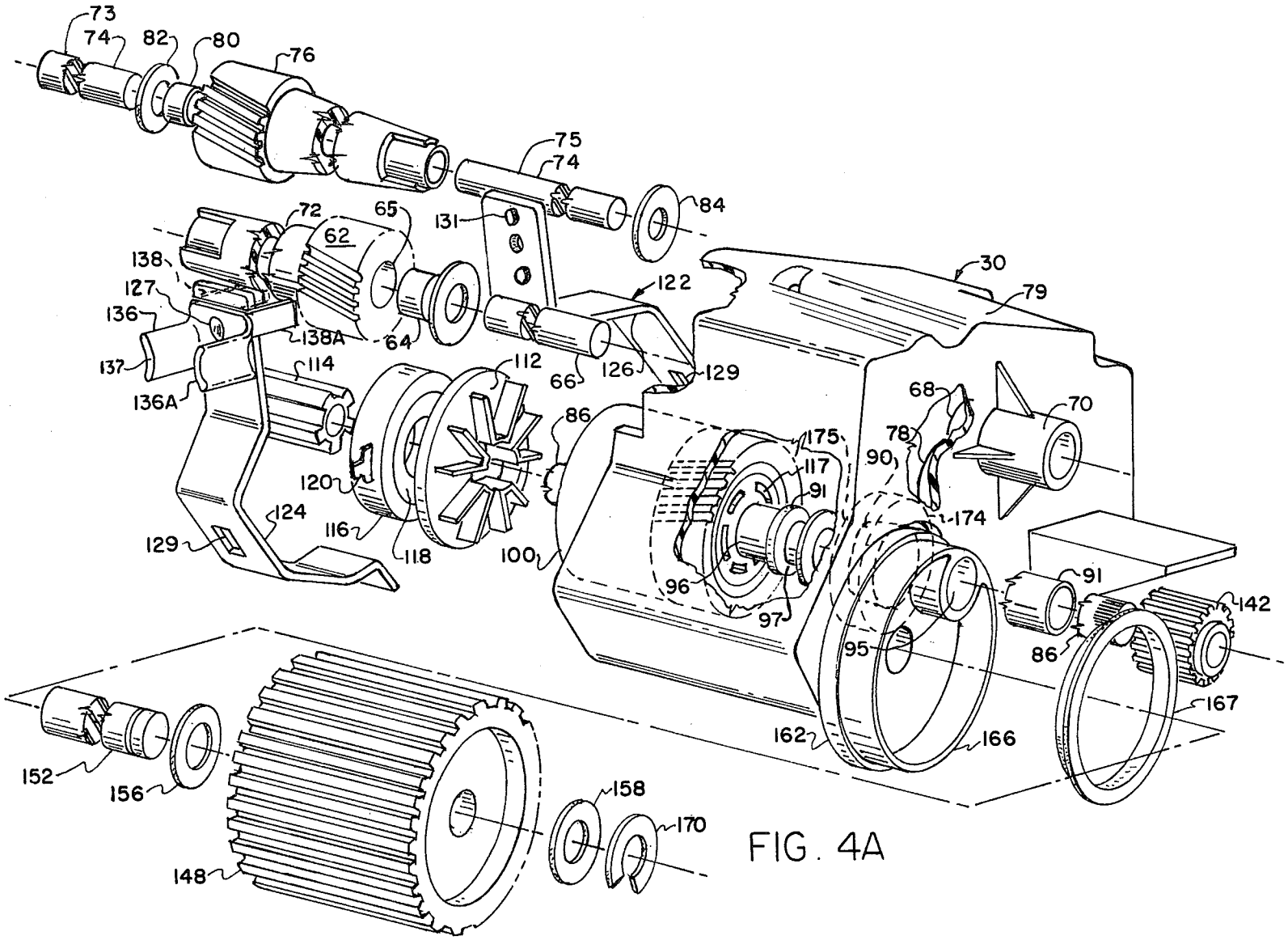

A flow of continuous cooling air to the clutch disks 102, 103, 104, 104A, 105, 105A, 106, 107, 108 and 109 is occasioned by internal blading (FIG. 4) in hubbed gears 92,94, such as vanes 111 (a total of 10) in hubbed gear 92. These vanes are arranged to form a centrifugal fan configuration 113. The blades draw air from six circumferential slots 115 in hubbed gear 92, arranged equidistantly and extending axially through the geared portion of hubbed gear 92. Hubbed gear 94 has similar slots 117 (six).

The flow of cooling air in the geared hub 92 (FIG. 8, 15 and 16) passes between an internal periphery of it and the radial outer extent of the clutch disks, e.g. disks 102, 104, 104A, 106, and 108 through an axially extending series of channels 119 (five) between the ribs of the hubbed gear 92. This provides an outer flow of cooling air for the clutch disks. An inner flow is also provided through a stepped channel 121 formed between the inner bore periphery of the clutch disks 102, 104, 104A, the indented spaces between the splines on splined piece 114 and around the splines and through oblong slots 123 (five) in the clutch disks 106 and 108.

Air follows these inner and outer paths to finally exhaust through slot 176. Hub gear 94 has a similar flow for cooling which takes the same inner and outer paths through it and its clutching disks. Of course, the ventilation air enters through housing slots 172 and 174 to flow through the clutch disks for the transmission 30.

Entrance through the slot 172 (and also similarily the slot 174) exhausts air into a tunnel 187 (FIG. 5) of annular volumetric shape formed between the output shaft 86 and the hollow cylinder formed by tapering, generally hollow cylinder boss 190 extending into an annular groove 192 in gear 92. This provides a tortuous leak path for air so that the main flow of air through slot 172 is directed across and through the clutch disks. The filter 173, disposed in boss 190, is a split ring with the gap in the ring shape occupied by a projection 194 of boss 154 which positively locates the filter 173.

Figure 12:
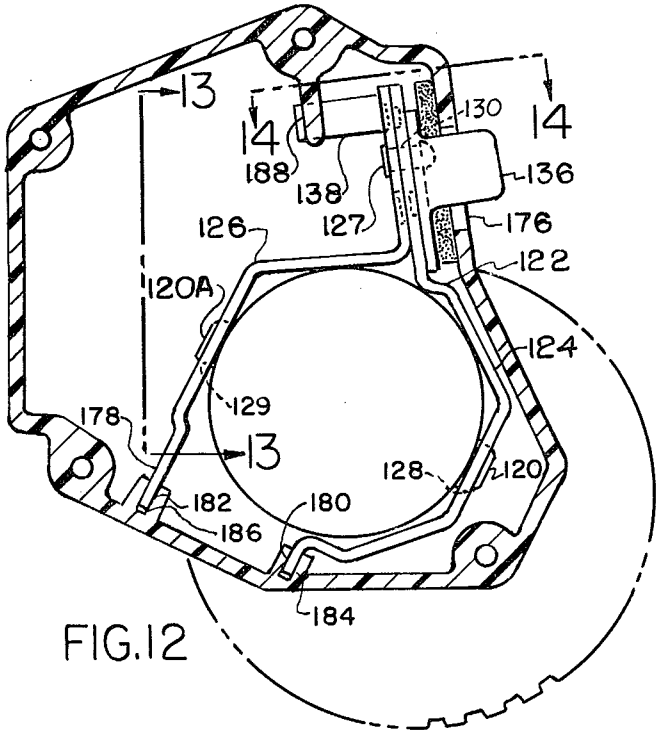
FIG. 12 is a cross sectional view of the housing structure showing details of the clutch actuator.
Figure 3:
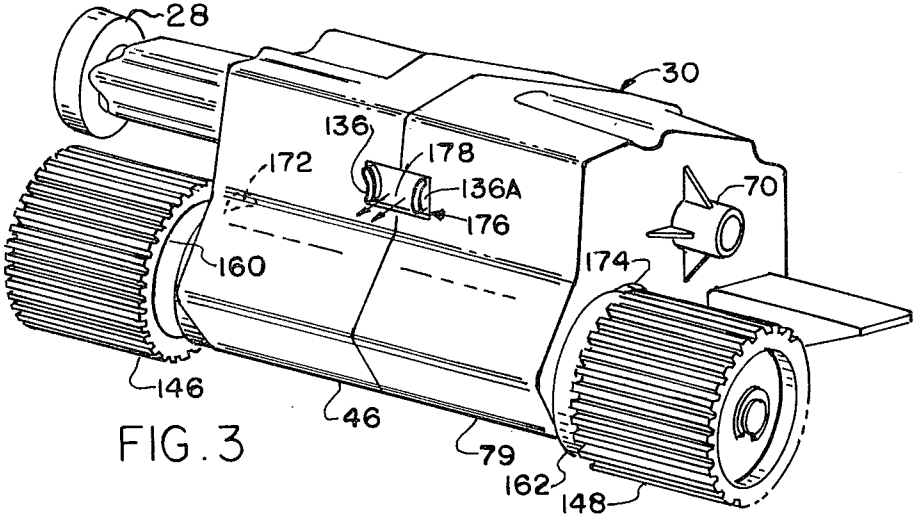
FIG. 3 is a perspective view of the transmission of the invention as housed.
Figure 13:
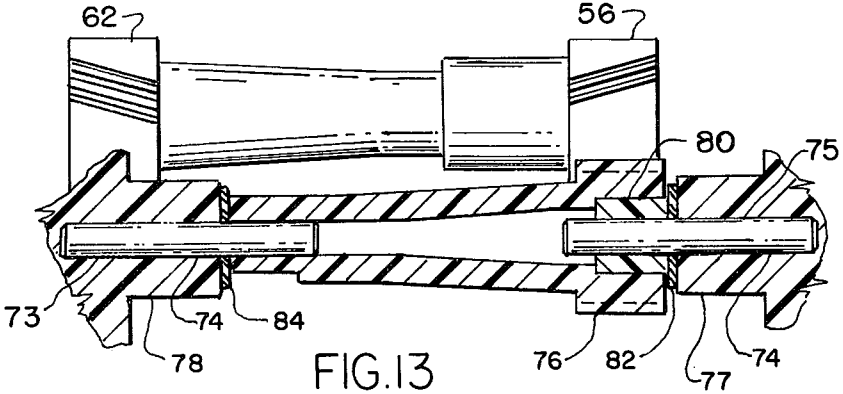
FIG. 13 is a back view somewhat like FIG. 5 but showing the lay shaft.

Clutch actuator 122 (FIG. 12) is maintained within the housing halves 46 and 79 radially by its ends 178 and 180 sliding in rib formed slots 182 and 184 in the housing of the transmission 30. The slot is closed laterally by end ribs (not shown). Axial movement of clutch actuator 122 is limited by tabs 136 and 136A in central slot 176 and radially inwardly extending tabs 138 and 138A which can move between two ribs 188, 189 (only one shown) extending axially in the housing for the transmission 30. These two tabs 138, 138A can ideally be formed from a spring like steel material so as to tend to center the transmission 30 and place it in neutral when either forward or rearward drive is not desired.

It should be obvious, therefore, that the objects of the invention has been complied with by the embodiment described and that, for example, a structure having both a lay and an output shaft with clutching, such clutching disposition thought to provide a more compact transmission is included that effective clutch cooling is included and that all other features of the invention will be apparent. Further many modifications will obviously occur to one skilled in the art which will still fall within the spirit and purview of the description offered

What is claimed is:

1. A power driven cleaner including;

(a) a handle operated means for controlling a pivoted actuating lever, (b) a transmission disposed adjacent said actuating lever, (c) said transmission including a first input shafting, (d) said input shafting driven by a motor for said cleaner, (e) an output shaft in said transmission, (f) gear engagement between said input and output shafts, (g) clutching means on said output shaft for engaging said output shaft with said input shaft through said gear engagement, (h) said output shaft including outboard gears that directly engage wheels for said cleaner to drive said wheels to propel said cleaner when said actuating lever is pivoted, (i) said clutching means take the form of clutch plates disposed in the hub of at least an output gear, (j) some of said clutch plates interengaging with and always rotating with said output gear and some of said clutch plates interengaging with and always rotating with said shaft, (k) whereby movement of said clutch plates axially on said output shaft frictionally engage them to clutch said output gear to said shaft, (l) cooling vanes are mounted with said output gear, (m) said output gear always rotating with said input shaft, (n) whereby said vanes supply cooling air to said clutch plates during rotation of said input shaft,
(o) said hub is slotted to provide ventilation for said clutch plates,
(p) said clutch plates and said hub have spaced locations therebetween to provide channels for the passage of ventilating air radially outwardly of the clutch disks, and
(g) said cooling vanes are mounted internally of said hub.

2. A power driven cleaner as set out in claim 1 wherein:
(a) slots are provided between said clutch disks, adjacent said output shaft to provide ventilation air radially inwardly of said clutch disks.

3. A power driven cleaner including:
(a) a handle operated means for controlling a pivoted actuating lever,
(b) a transmission disposed adjacent said actuating lever,
(c) said transmission including a first input shafting,
(d) said input shafting driven by a motor for said cleaner,
(e) an output shaft in said transmission,
(f) gear engagement between said input and output shafts,
(g) clutching means on said output shaft for engaging said output shaft with said input shaft through said gear engagement,
(h) said output shaft including outboard gears that directly engage wheels for said cleaner to drive said wheels to propel said cleaner when said actuating lever is pivoted,
(i) said clutching means includes a carriage movable axially along said output shaft,
(j) said carriage including at least one radially outwardly extending tab,
(k) said tab engaging a clutch actuator also movable axially relative to said output shaft,
(l) whereby clutching and declutching of said output shaft to said input shaft is occasioned by movement of said clutch actuator axially of said output shaft,
(m) said clutch actuator includes a pair of radially, inwardly extending tabs, and
(n) said tabs being of spring material and riding between a pair of ribs to tend to center said carriage and keep said transmission in neutral.

4. A power driven cleaner including;
(a) a handle operated means for controlling a pivoted actuating lever,
(b) a transmission disposed adjacent said actuating lever,
(c) said transmission including a first input shafting,
(d) said input shafting driven by a motor for said cleaner,
(e) an output shaft in said transmission,
(f) gear engagement between said input and output shafts.
(g) clutching means on said output shaft for engaging said output shaft with said input shaft through said gear engagement,
(h) said output shaft including outboard gears that directly engage wheels for said cleaner to drive said wheels to propel said cleaner when said actuating lever is pivoted,
(i) said clutching means take the form of clutch plates disposed in the hub of at least one output gear,
(j) some of said clutch plates interengaging with and always rotating with said output gear and some of said clutch plates interengaging with and always rotating with said shaft,
(k) whereby movement of said clutch plates axially on said output shaft frictionally engage them to clutch said output gear to said shaft,
(l) cooling vanes are mounted with said output gear,
(m) said output gear always rotating with said input shaft,
(n) whereby said vanes supply cooling air to said clutch plates during rotation of said input shaft,
(o) cooling impellers are mounted with said output shaft,
(p) said cooling impellers mounted with said output shaft rotating with said output shaft during driving thereof to thereby provide additional cooling air to said clutch plates,
(q) said cooling impellers extend inwardly towards said output shaft,
(r) splines mounted with said output shaft, and
(s) said cooling impellers at their inward extension engaging with said splines to form a driving connection therebetween.

5. A power drive cleaner including a transmission having;
(a) an input shaft,
(b) an output shaft,
(c) a gear mounted with one of said input shaft and said output shaft,
(d) a housing for said transmission,
(e) said gear disposed in said housing and including directly attached cooling vanes, within said gear, rotating with said gear as said gear rotates,
(f) slots through said gear permitting said cooling vanes to circulate cooling air,
(g) said cooling vanes disposed adjacent said slots, and
(h) rotation of said gear cooling and transmission.

6. A power drive cleaner including a transmission having;
(a) an output shaft,
(b) an input shaft,
(c) a gear mounted on one of said input shaft and said output shaft,
(d) said gear including a hub,
(e) cooling vanes mounted internally of said hub to provide a ventilation effect for said transmission.
(f) slots through said gear permitting said cooling vanes to circulate cooling air, and
(g) said cooling vanes disposed adjacent to said slots.

7. A power drive cleaner including a transmission having;
(a) an input shaft,
(b) an output shaft,
(c) a means for clutching and declutching said transmission including a carriage movable axially along one of said shafts and also including a clutch actuator movable axially relative to at least one of said shafts,
(d) said clutch actuator including a pair of radially, inwardly extending tabs, and
(e) said tabs being of spring material and riding between a pair of ribs to tend to center said carriage and keep said transmission in neutral.

8. A power drive cleaner including a transmission having;
(a) an input shaft, (b) an output shaft,
(c) a means for clutching said transmission to engage or disengage it,
(d) said means for clutching including clutch plates disposed on at least one of said shafts,
(e) cooling impellers provided for said means for clutching, and
(f) said cooling impellers serving as the means forcing said clutch plates together to facilitate clutching action.

9. The power driven cleaner as claim 8 wherein;
(a) said cooling impellers rotating upon rotation of said output shaft to insure cooling air when the clutch plates are loaded.

10. A power drive cleaner including a transmission having;
(a) an input shaft,
(b) an output shaft,
(c) cooling impellers mounted with one of said shafts,
(d) said cooling impellers rotating with said one of said shafts,
(e) said cooling impellers extending inwardly towards said one of said shafts,
(f) splines at least on said one of said shafts, and
(g) said cooling impellers at their inward extension engaging with said splines to form a driving connection therebetween.

11. A cooling system for a clutching arrangement including;
(a) a hubbed gear,
(b) a plurality of clutch disks in said hubbed gear,
(c) cooling vanes in said hubbed gear,
(d) slots through said gear permitting said cooling vanes to circulate air to said clutch disks,
(e) said cooling vanes disposed totally within said hubbed gear, and
(f) said cooling vanes disposed adjacent said slots.

* * * * *